US007748194B2

(12) United States Patent
Carless

(10) Patent No.: US 7,748,194 B2
(45) Date of Patent: Jul. 6, 2010

(54) CLOSURE FRAME CORNER JOINT

(75) Inventor: John W. Carless, Howell, MI (US)

(73) Assignee: Milgard Manufacturing, Inc., Tacoma, WA (US)

( * ) Notice: Subject to any disclaimer, the term of this patent is extended or adjusted under 35 U.S.C. 154(b) by 1048 days.

(21) Appl. No.: 11/282,920

(22) Filed: Nov. 18, 2005

(65) Prior Publication Data

US 2007/0113497 A1 May 24, 2007

(51) Int. Cl.

| | |
|---|---|
| ***E06B 3/96*** | (2006.01) |
| ***E06B 3/30*** | (2006.01) |
| ***E04C 2/38*** | (2006.01) |
| ***F16B 9/00*** | (2006.01) |

(52) U.S. Cl. ..... 52/656.2; 52/204.57; 52/656.4; 52/656.9; 160/379; 403/231

(58) Field of Classification Search ..... 52/204.57, 52/656.2, 656.1, 656.4, 656.5, 656.6, 656.9; 160/379, 381, 371; 403/231, 403

See application file for complete search history.

(56) References Cited

U.S. PATENT DOCUMENTS

| | | | | | |
|---|---|---|---|---|---|
| 3,561,801 | A | * | 2/1971 | Chiu | 403/264 |
| 3,772,837 | A | * | 11/1973 | Hunt | 52/127.12 |
| 3,798,863 | A | | 3/1974 | Latson | |
| 3,844,084 | A | * | 10/1974 | Hubbard et al. | 52/843 |
| 4,078,288 | A | * | 3/1978 | Abramson | 29/897.312 |
| 4,164,105 | A | | 8/1979 | Herbst et al. | |
| 4,334,797 | A | * | 6/1982 | Wahlin | 403/252 |
| 4,434,594 | A | | 3/1984 | Bliss | |
| 4,444,525 | A | | 4/1984 | Alander | |
| 4,624,091 | A | | 11/1986 | Biro | |
| 4,747,248 | A | * | 5/1988 | Fahs | 52/455 |
| 4,753,043 | A | | 6/1988 | Bockwinkel | |
| 4,757,657 | A | | 7/1988 | Mitchell et al. | |
| 4,924,631 | A | | 5/1990 | Davies et al. | |
| 4,987,709 | A | | 1/1991 | Bucci | |

(Continued)

FOREIGN PATENT DOCUMENTS

| | | |
|---|---|---|
| DE | 19547471 C1 | 12/1996 |

(Continued)

*Primary Examiner*—Richard E Chilcot, Jr.
*Assistant Examiner*—Ryan D Kwiecinski
(74) *Attorney, Agent, or Firm*—Reising Ethington PC

(57) ABSTRACT

A closure assembly includes a frame having at least one hollow end rail and a pair of side rails coupled in butt joints to opposed ends of the end rail. The butt joints include a core extending through the hollow end rail and from opposed ends of the end rail through openings in the side rails into the interiors of the side rails. A saddle within each side rail interior straddles a corresponding end of the core. A fastener extends through each of the saddles into engagement with a corresponding end of the core firmly to clamp to side rails against opposed ends of the end rail. The core preferably is of uniform cross-section throughout its length, having edges that internally engage the hollow end rail against lateral movement of the core within the end rail. A resilient washer preferably is captured in compression between each saddle and the opposing end of the core. One of the saddles preferably has an integrally formed extension within one of the side rails for securement of a hinge to the side rail.

14 Claims, 3 Drawing Sheets

U.S. PATENT DOCUMENTS

| | | | | | |
|---|---|---|---|---|---|
| 5,297,891 | A | * | 3/1994 | Rosa | 403/402 |
| 5,345,678 | A | | 9/1994 | Ronnlund | |
| 5,363,625 | A | * | 11/1994 | Philippi | 52/653.2 |
| 5,479,733 | A | | 1/1996 | Kusina | |
| 5,603,585 | A | | 2/1997 | Bruchu et al. | |
| 5,647,172 | A | | 7/1997 | Rokicki | |
| 5,655,348 | A | * | 8/1997 | Paradise | 52/656.4 |
| 5,657,604 | A | * | 8/1997 | Malott | 52/655.1 |
| 5,761,860 | A | * | 6/1998 | Koike et al. | 52/204.67 |
| 5,778,598 | A | * | 7/1998 | Ohanesian | 49/74.1 |
| 5,875,600 | A | | 3/1999 | Redman | |
| 6,006,478 | A | | 12/1999 | Hubner et al. | |
| 6,067,760 | A | | 5/2000 | Nowell | |
| 6,079,169 | A | * | 6/2000 | Ashworth | 52/217 |
| 6,134,857 | A | | 10/2000 | Hope | |
| 6,318,036 | B1 | | 11/2001 | Siudzinski et al. | |
| 6,412,239 | B1 | | 7/2002 | Miller | |
| 6,481,177 | B1 | | 11/2002 | Wood | |
| 6,619,005 | B1 | | 9/2003 | Chen | |
| 6,851,244 | B2 | * | 2/2005 | Vilhauer | 52/656.9 |
| 2002/0032995 | A1 | | 3/2002 | Siudzinski et al. | |
| 2005/0193680 | A1 | * | 9/2005 | Wang | 52/656.9 |
| 2006/0048476 | A1 | * | 3/2006 | Krapf et al. | 52/656.9 |
| 2008/0063468 | A1 | * | 3/2008 | Wernlund et al. | 403/230 |

FOREIGN PATENT DOCUMENTS

| | | |
|---|---|---|
| GB | 2022757 | 5/1979 |
| GB | 2161195 A | 1/1986 |

* cited by examiner

CLOSURE FRAME CORNER JOINT

The present disclosure relates to building closure assemblies such as windows and doors, and more particularly to a frame corner butt joint for such a closure assembly.

BACKGROUND AND SUMMARY OF THE DISCLOSURE

Building closure assemblies of current design, such as patio doors, typically require up to six crews to form the butt joint at each corner of the door frame. Alignment and assembly at the four corners of the frame can be a laborious and costly operation. It is a general object of the present disclosure to provide a butt joint for a building closure assembly that can be economically fabricated and yet form a rigid frame with a good seal at each butt joint against water infiltration.

The present disclosure embodies a number of aspects that can be implemented separately from or in combination with each other.

A closure assembly in accordance with one aspect of the present disclosure includes a frame having at least one hollow end rail and a pair of side rails coupled in butt joints to opposed ends of the end rail. The butt joints include a core extending through the hollow end rail and from opposed ends of the end rail through openings in the side rails into the interiors of the side rails. A saddle within each side rail interior straddles a corresponding end of the core. A fastener extends through each of the saddles into engagement with a corresponding end of the core firmly to clamp to side rails against opposed ends of the end rail. The core preferably is of uniform cross-section throughout its length, having edges that internally engage the hollow end rail against lateral movement of the core within the end rail. A resilient washer preferably is captured in compression between each saddle and the opposing end of the core. One of the saddles preferably has an integrally formed extension within one of the side rails for securement of a hinge to the side rail.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figures 1, 2:
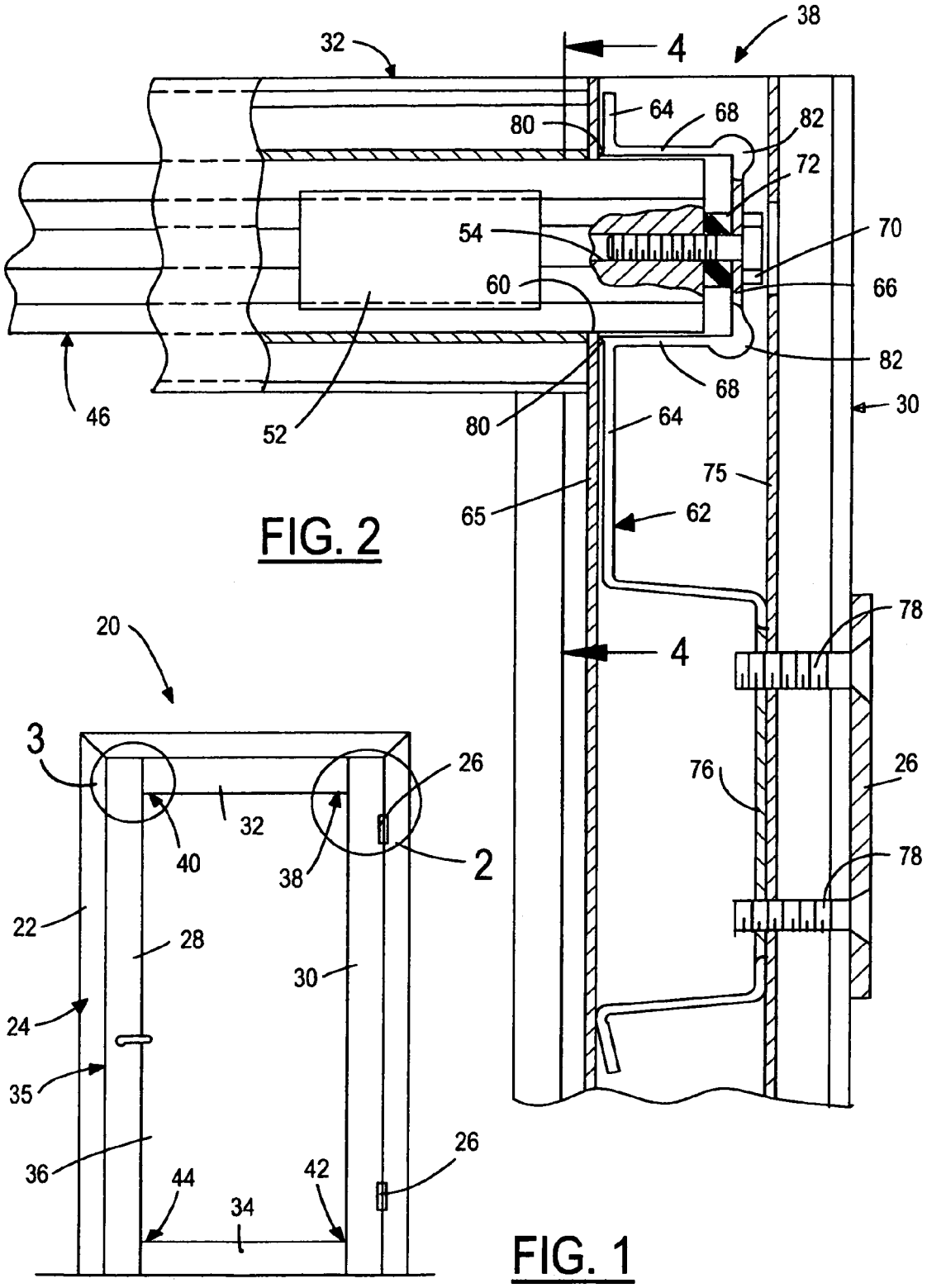
FIG. 1 an elevational view of a closure assembly in the form of a patio door in an exemplary embodiment of the present disclosure.
FIG. 2 is a fragmentary partially sectioned elevational view of the portion of FIG. 1 within the area 2.

FIG. 1 illustrates a building closure 20 in the form of a patio door in accordance with an exemplary embodiment of the present disclosure. Closure 20 includes a closure assembly 24 mounted within a fixed frame 22, such as by hinges 26. Closure assembly 24 includes a pair of side rails 28, 30 and a pair of end rails 32, 34 assembled to form a generally rectangular frame 35. A panel 36 of glass or other suitable material is captured within closure assembly 24. Closure assembly has butt joints 38, 40 at the upper corners of the assembly and butt joints 42, 44 at the lower corners of the assembly. Butt joint 38 is illustrated in detail in FIGS. 2 and 4-5, and butt joint 40 is illustrated in detail in FIG. 3. Butt joints 42, 44 preferably are mirror images of butt joints 38, 40 respectively. Side rails 28, 30 and end rails 32, 34 preferably are of fiberglass-reinforced resin construction, although any suitable materials can be employed for the rails such as vinyl or aluminum. The side and end rails typically are of pultruded or extruded construction and of uniform cross-section throughout their lengths. End rails 32, 34 are hollow. Side rails 28,30 are hollow at their ends for forming the butt joints, and can have either hollow or filled mid portions.

Figure 4:
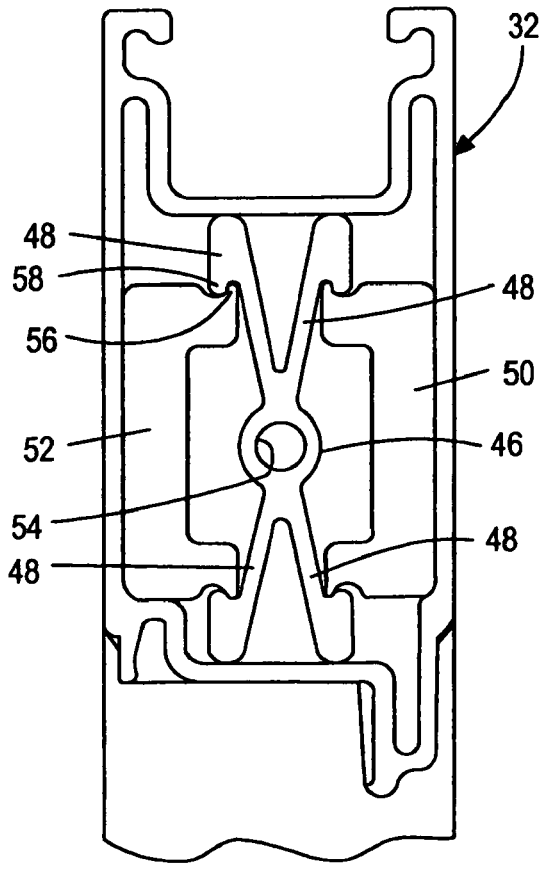
FIG. 4 is a fragmentary sectional view taken substantially along the line 4-4 and FIG. 2.
Figure 5:
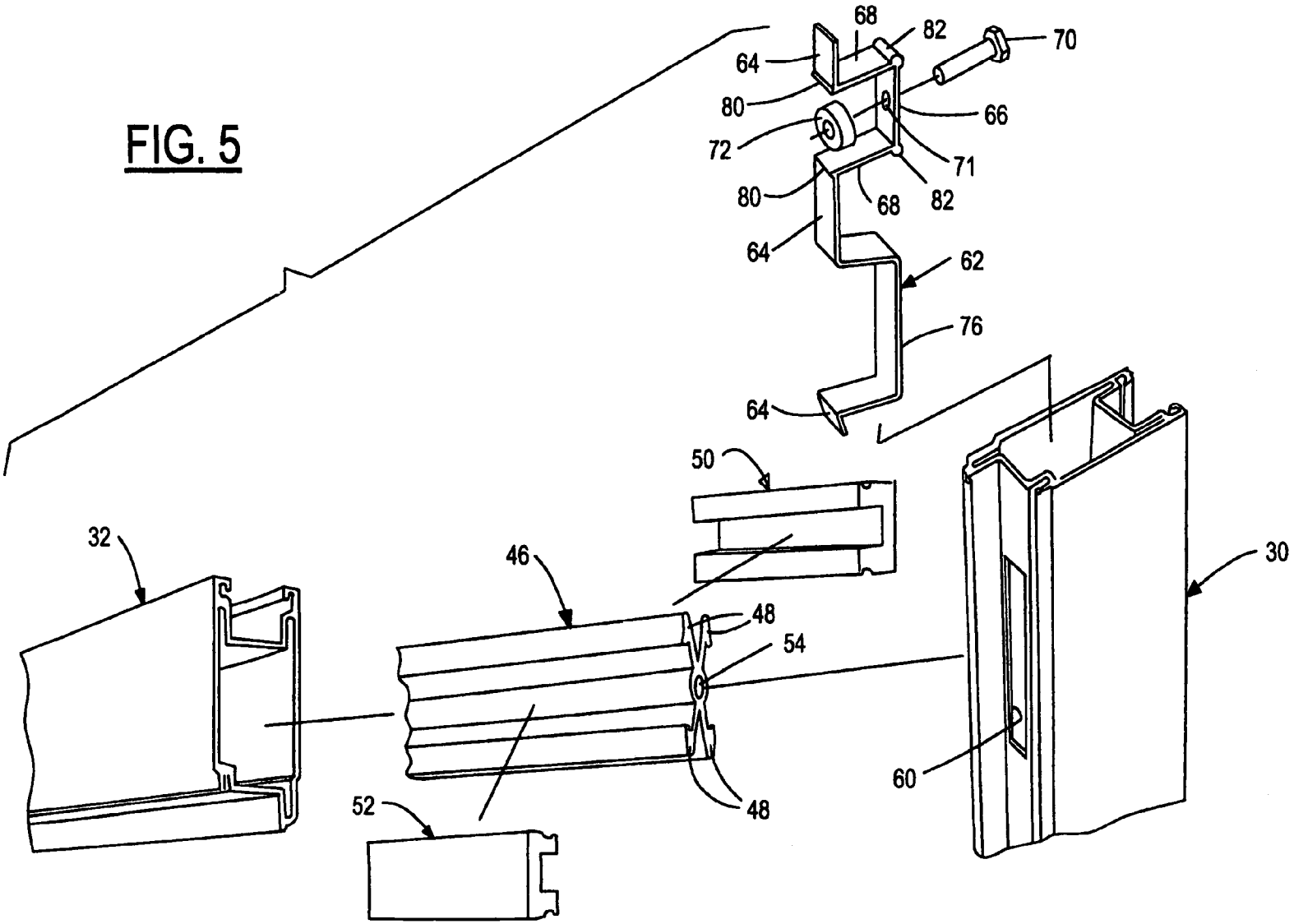
FIG. 5 is an exploded perspective view of the closure assembly butt joint illustrated in FIG. 2.

Referring to FIGS. 2 and 4-5, butt joint 38, where end rail 32 connects with side rail 30, includes a core 46 that extends entirely through the hollow interior of end rail 32. As best seen in FIG. 4, core 46 has a generally X-shaped cross-section with legs 48 that interiorly engage the cross-section of hollow end rail 32 to reduce or prevent vertical lateral movement of core 46 within end rail 32. A pair of bearing blocks 50, 52 engage legs 48 of core 46 and mount core 46 for lengthwise sliding movement within rail 32 while reducing or preventing horizontal lateral movement of core 46 within rail 32. Bearing blocks 50, 52 may be of any suitable material such as plastic. Core 46 is of uniform cross-section throughout its length and may be of extruded aluminum or other rigid construction, for example. There is a central opening 54 in core 46 that preferably extends through the entire length of the core. Bearing blocks 50, 52 have opposed outwardly extending lips 56 that are captured by snap-fit within inwardly extending beads 58 on core legs 48.

One end of core 46 extends through a side opening 60 in side rail 30 and into the interior of the side rail. A saddle 62 is disposed within the interior of side rail 30 adjacent to the end of the side rail and straddles the end of core 46 extending into the side rail. Saddle 32 includes a base 64 adjacent to the wall 65 of rail 30 and a platform 66 connected to base 64 by a pair of spaced legs 68. Legs 68 are disposed on opposed sides of the end of core 46 received within rail 30. A threaded fastener 70 extends through an opening 71 (FIG. 5) in saddle platform 66 into opening 54 of core 46. Fastener 70 may be a self-tapping screw or bolt. A resilient washer 72 is captured in compression between the undersurface of platform 66 and the opposing end surface of core 46. Fastener 70 is accessible through a laterally outwardly facing opening 74 (FIG. 2) in wall 75 of side rail 30. Saddle 62 preferably has a second platform 76 formed as an integral extension of the saddle that extends into the interior of side rail 30. The purpose of platform 76 is to provide for securement of door hinge 26, such as by means of threaded fasteners 78 that extend into platform 76. Saddle 62 is of uniform width, as best seen in FIG. 5, and can be of extruded aluminum construction for example.

Figure 3:
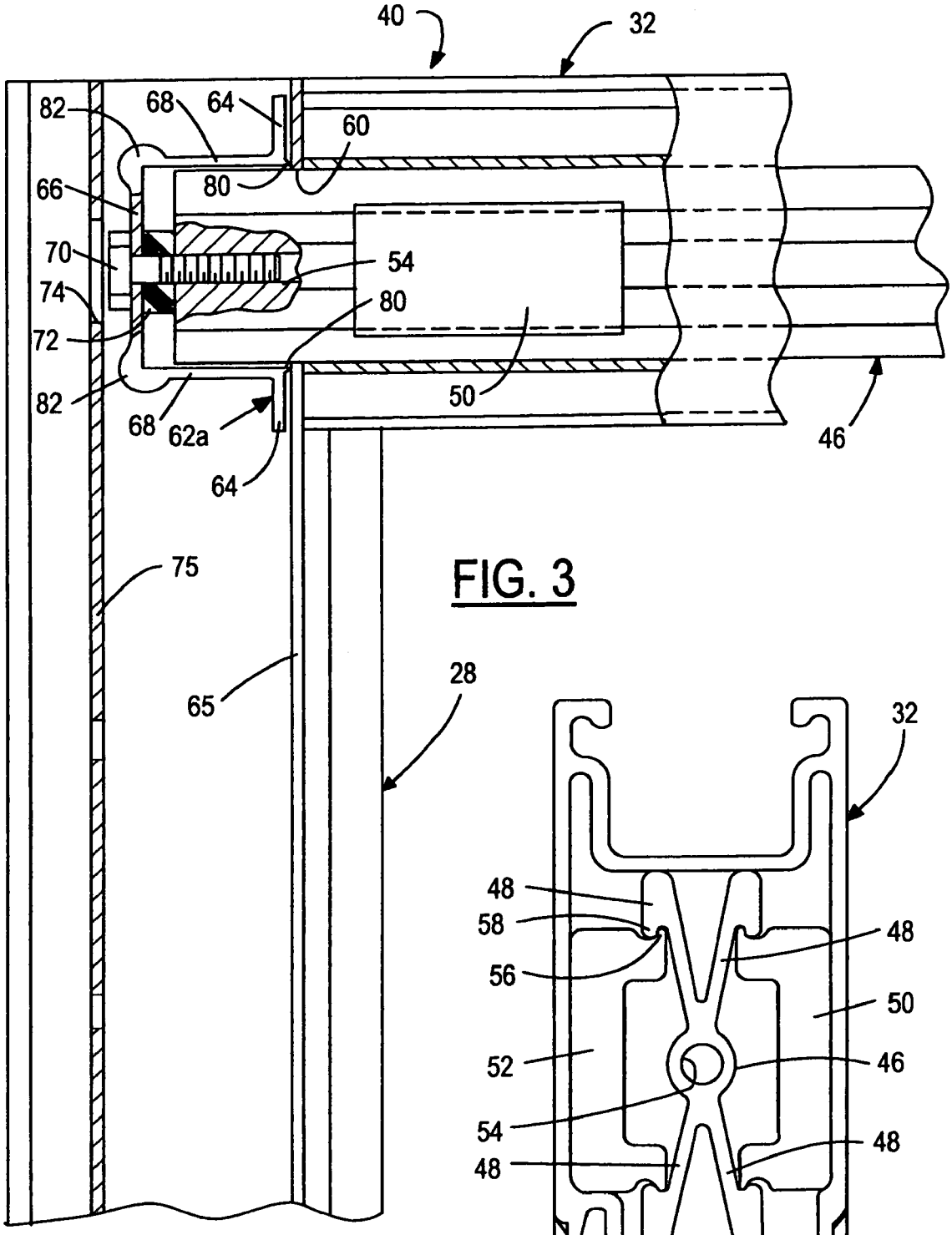
FIG. 3 is a fragmentary partially sectioned elevational view of the portion of FIG. I within the area 3.

Butt joint 40 in FIG. 3 is a mirror image of butt joint 38 in FIGS. 2 and 4-5 except that the saddle 62*a* in butt joint 40 need not have the integral extension that forms platform 76 because there are no door hinges attached to side rail 28. (Of course, saddle 62*a* in FIG. 3 can be identical to saddle 62 in FIGS. 2 and 5, and the saddle extension not used.) Otherwise, elements in butt joint 40 that are identical to corresponding elements in butt joint 38 are indicated by correspondingly identical reference numerals in FIG. 3.

To assemble butt joints 38, 40, core 46 and bearing blocks 50, 52 are positioned within end rail 46. Fasteners 70 and washers 72 are assembled to saddles 62, 62*a*, and the saddles are positioned within the ends of side rails 30, 28 with the platforms 66 of the respective saddles being generally aligned with side openings 60 in the respective side rails. The ends of core 46 that protrude from the ends of end rail 32 are then positioned through side rail openings 60 into the spaces between legs 68 of saddles 62, 62*a*, and fasteners 70 are threaded into openings 54 of core 46. The bases 64 of saddles 62, 62*a* are in interior engagement with the inside walls 65 of side rails 30, 28 and firmly clamp side rails 30, 28 into abutting engagement with the opposed ends of rail 32.

Washers 72 not only loosely mount fasteners 70 on saddles 60, 62*a* during the assembly operation, 5 but also accommodate tolerance variations in the length of core 46, the dimensions of saddles 62, 62*a*, etc. The corners where legs 68 meet platform 66 are rigidified by enlargements 82. As noted above, butt joints 42, 44 (FIG. 1) preferably are mirror images of butt joints 38, 40.

The corner butt joint of the present disclosure thus is economical to assemble and can readily be disassembled if needed to replace a glass panel for example. Furthermore, the butt joint of the present disclosure retards heat transfer through the closure assembly. It will be noted in FIG. 4, for example, that the ends of core legs 48 have only limited contact with the interior surfaces of rail 32, while bearing blocks 50, 52 may be of insulating materials such as plastic. Bearing blocks 50, 52 not only enable sliding movement of core 46 to facilitate assembly to the side rails, but also center core 46 within the hollow interior of end rail 32 to facilitate alignment with fasteners 70 in the side rails. There preferably are barbs 80 on the inside ends of saddle legs 68, which engage walls of side rails 30, 28 as fasteners 70 are tightened. There is limited contact between saddles 60, 62*a* and side rails 30, 28 to limit heat transfer through the corner joint.

There thus have been disclosed a closure assembly and method of manufacture that fully satisfy all of the objects and aims previously set forth. The present disclosure has been presented in conjunction with several exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A closure assembly that includes:

a frame having at least one hollow end rail and a pair of side rails coupled to opposed ends of said end rail in butt joints that include:

a core extending through said hollow end rail, and from opposed ends of said end rail through openings in said side rails into interiors of said side rails, a saddle within the interior of each said side rail straddling a corresponding end of said core, and a fastener extending through each of said saddles into engagement with a corresponding end of said core firmly to clamp said saddles against inside surfaces of said side rails and thereby clamp said side rails to opposed ends of said end rail, wherein said core is of uniform cross-section throughout its length, including end portions of said core that extend from opposite ends of said end rail through openings in said side rails, said cross-section having edges that internally engage said hollow end rail against lateral movement of said core within said end rail, said cross-section of said core having openings at opposed ends of said core for receiving said fasteners from a direction lengthwise of said core.

2. The closure assembly set forth in claim 1 wherein said core is slidably mounted within said end rail.

3. The closure assembly set forth in claim 2 including bearing blocks slidably supporting said core within said end rail.

4. The closure assembly set forth in claim 1 wherein said fasteners comprise threaded fasteners.

5. The closure assembly set forth in claim 1 including a resilient washer around each said fastener and captured in compression between each said saddle and an opposing end of said core.

6. The closure assembly set forth in claim 1 wherein each said saddle includes a platform through which said fastener extends into said core and a pair of legs that internally engage said side rail on opposed sides of said core.

7. The closure assembly set forth in claim 6 wherein said saddle is rigidified where said legs connect with said platform.

8. The closure assembly set forth in claim 6 wherein one of said saddles has an integrally formed extension within one of said side rails for securement of a hinge to said one of said side rails.

9. The closure assembly set forth in claim 1 including a pair of said hollow end rails at opposed ends of said assembly, each of said end rails being coupled to said side rails by one of said butt joints.

10. A closure assembly that includes:

a frame having at least one hollow end rail and a pair of side rails coupled to opposed ends of said end rail in butt joints that include:

a rigid core extending through said hollow end rail and from opposed ends of said end rail through openings in said side rails into interiors of said side rails, said core being of uniform cross-section throughout its length and having edges that internally engage said hollow end rail against lateral movement of said core within said end rail, a saddle within the interior of each said side rail, each said saddle including a platform spaced from a corresponding end of said core and a pair of legs that straddle said end of said core and internally engage said side rail on opposed sides of said core, a threaded fastener extending through each of said saddles into threaded engagement with a corresponding end of said core firmly to clamp said side rails to opposed ends of said end rail, and a resilient washer around each said fastener and captured in compression between each said saddle platform and an adjacent end of said core, wherein said core is of uniform cross-section throughout its length, including end portions of said core that extend from opposite ends of said end rail through openings in said side rails, said cross-section having edges that internally engage said hollow end rail against lateral movement of said core within said end rail, said cross-section of said core having openings at opposed ends of said core for receiving said fasteners from a direction lengthwise of said core.

11. The closure assembly set forth in claim 10 wherein said core is slidably mounted within said end rail.

12. The closure assembly set forth in claim 11 including bearing blocks slidably supporting said core within said end rail.

13. The closure assembly set forth in claim 10 wherein said saddle is rigidified where said legs connect with said platform.

14. The closure assembly set forth in claim 10 wherein one of said saddles has an integrally formed extension within one of said side rails for securement of a hinge to said one of said side rails.

* * * * *